US006372399B1

(12) United States Patent
Tomura

(10) Patent No.: US 6,372,399 B1
(45) Date of Patent: Apr. 16, 2002

(54) DEVELOPING AGENT, IMAGE FORMING APPARATUS

(75) Inventor: Shinya Tomura, Yamato (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/553,471

(22) Filed: Apr. 20, 2000

(51) Int. Cl.[7] ..... G03G 9/00; G03G 13/20

(52) U.S. Cl. ..... 430/108.23; 430/109.3; 430/109.4; 430/111.4; 430/124; 399/335

(58) Field of Search ..... 430/108.23, 109.3, 430/109.4, 111.4, 124; 399/335

(56) References Cited

U.S. PATENT DOCUMENTS 5,483,327 A 1/1996 Taya et al. ..... 355/245
5,853,940 A * 12/1998 Kido et al. ..... 430/109.3
5,968,698 A * 10/1999 Honda ..... 430/111.4
6,063,537 A * 5/2000 Nakamura et al. ..... 430/111.4

FOREIGN PATENT DOCUMENTS

| | | |
|---|---|---|
| JP | 52-139435 | 11/1977 |
| JP | 1-134385 | 5/1989 |
| JP | 7-28357 | 1/1995 |
| JP | 7-34136 | 4/1995 |
| JP | 7-98519 | 4/1995 |
| JP | 7-181821 | 7/1995 |

* cited by examiner

*Primary Examiner*—Mark Chapman
(74) *Attorney, Agent, or Firm*—Foley & Lardner

(57) ABSTRACT

A developing agent comprising a toner particle containing a binder resin having an acid value of 1 to 30, a glass transition temperature of 40 to 65° C. and a softening point of 80 to 140° C., an azo-based iron complex, and a colorant and/or a first magnetic particle. This developing agent is suited for use in a fixing device of electromagnetic induction heating system.

20 Claims, 1 Drawing Sheet

DEVELOPING AGENT, IMAGE FORMING APPARATUS

BACKGROUND OF THE INVENTION

The present invention related to an image-forming apparatus such as an electrophotographic device, an electrostatic recording device, to an image-forming method using such an image-forming apparatus, and to a developing agent to be used in such an image-forming apparatus.

As a method of fixing a toner image, after being transferred to a recording material, and the toner image having been obtained through the development of an electrostatic latent image formed on an image carrier, there are conventionally known various method such as a heat fixing method, a pressure fixing method, a flash fixing method, a high-frequency heat fixing method, an electromagnetic induction heating method, etc.

In particular, according to the electromagnetic induction heating method, an electric current is passed through a coil wound around a core, thereby generating Joule heat in concurrent with a magnetic field, the resultant Joule heat being utilized as a heat source for the fixing. With respect to the technique using this electromagnetic induction heating method, Japanese Patent Unexamined Publication S52-139435 discloses a method wherein the heating is performed by making use of fixing means using a combination of a coil constructed as mentioned above and a heating element. This fixing means however is accompanied with a problem that due to the generation of non-uniformity of temperature distribution in the heating element, it is difficult to obtain an image of stabilized image concentration.

Further, Japanese Patent Unexamined Publication H1-134385 discloses a fixing method using the electromagnetic induction heating method, wherein a one-component magnetic toner comprising a combination of metallic or magnetic particle and a thermoplastic resin is employed.

According to this fixing method, the metallic or magnetic particle in a toner is allowed to develop heat through an electromagnetic induction heating, thereby causing the thermoplastic resin in the toner to melt and to achieve the fixing. Therefore, only the portions required can be selectively heated, thus making it possible to shorten the warm-up time. Further, since the surrounding parts and devices are not heated up in a substantial degree, there is no need to take the temperature rise of these surrounding parts and devices into consideration. Additionally, it is possible to make the fixing system much smaller.

This fixing method however is defective in that the one-component magnetic toner containing a large quantity of magnetic power tends to scatter at the step of fixing due to an influence of magnetic field, thereby disturbing the image being fixed. Further, this fixing method however is accompanied with a problem that the toner cannot be used in a binary developing system.

BRIEF SUMMARY OF THE INVENTION

The present invention has been accomplished in view of the aforementioned circumstances, and therefore, a first object of the present invention is to provide a developing agent which is suited for use in an electromagnetic induction heating system and which enables to obtain an excellent image of stabilized image concentration.

A second object of the present invention is to provide an image-forming apparatus adapted for use in an electromagnetic induction heating system, which is small in size, is capable of shortening the warm-up time thereof as well as capable of saving energy consumption, and enables to obtain an excellent image of stabilized image concentration.

A third object of the present invention is to provide an image-forming method which enables to miniaturize an apparatus involved, to shorten the warm-up time, to save energy consumption, and to obtain an excellent image of stabilized image concentration.

According to a first aspect of the present invention, there is provided a developing agent comprising a toner particle containing a binder resin having an acid value of 1 to 30, a glass transition temperature of 40 to 65° C. and a softening point of 80 to 140° C., an azo-based iron complex, and a colorant and/or a first magnetic particle.

According to a second aspect of the present invention, there is provided an image-forming apparatus comprising;

an image carrier;

a developing device for forming a developing agent image through a development of an electrostatic latent image formed on the image carrier, the developing device being disposed opposite to the image carrier and containing a developing agent comprising a toner particle containing a binder resin having an acid value of 1 to 30, a glass transition temperature of 40 to 65° C. and a softening point of 80 to 140° C., an azo-based iron complex, and a colorant and/or a first magnetic particle;

a transferring device for transferring the developing agent image onto a recording material; and a fixing device of electromagnetic induction heating system for fixing the developing agent image transferred onto the recording material.

According to a third aspect of the present invention, there is provided an image-forming method which comprises the steps of;

forming an electrostatic latent image on an image carrier;

developing the electrostatic latent image with a developing agent comprising a toner particle containing a binder resin having an acid value of 1 to 30, a glass transition temperature of 40 to 65° C. and a softening point of 80 to 140° C., an azo-based iron complex, and a colorant and/or a first magnetic particle;

transferring a developing agent image thus developed onto a recording material; and fixing the developing agent image onto the recording material by heating the developing agent image according to an electromagnetic induction heating system while pressing the developing agent image transferred onto the recording material.

According to the present invention, since there is employed a developing agent containing a binder resin having an acid value of 1 to 30, a glass transition temperature of 40 to 65° C. and a softening point of 80 to 140° C., and an azo-based iron complex in a fixing system utilizing an electromagnetic induction heating method, it is now possible to obtain a high-quality image of high-fidelity to a latent image.

DETAILED DESCRIPTION OF THE INVENTION

Figure 1:
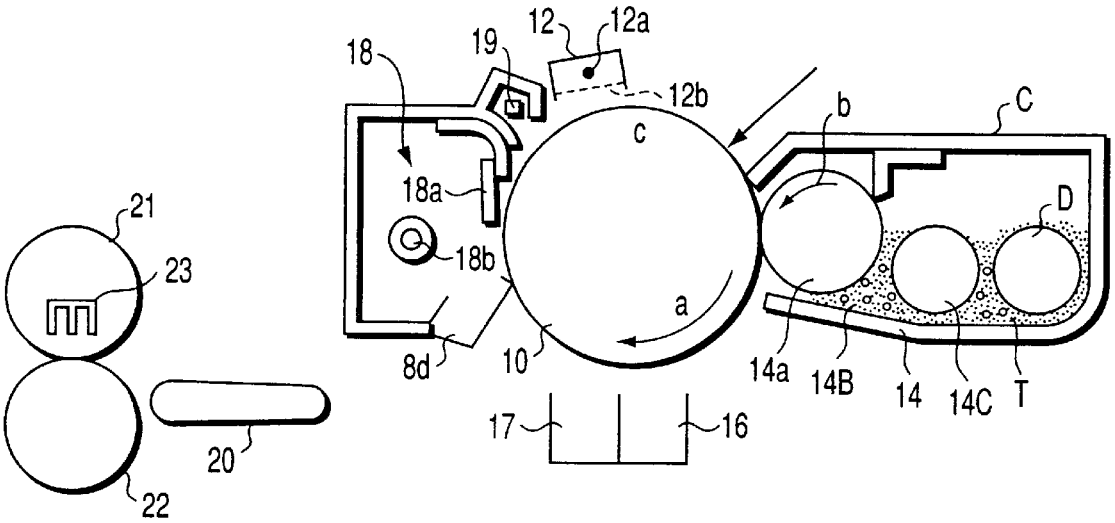
FIG. 1 is a schematic view illustrating the construction of an image-forming apparatus representing one example of the present invention.

The developing agent according to the present invention comprises a toner particle containing a binder resin and a colorant and/or a first magnetic particle, the binder resin having an acid value of 1 to 30, a glass transition temperature of 40 to 65° C. and a softening point of 80 to 140° C. Additionally, the developing agent according to the present invention further contains an azo-based iron complex.

Since the azo-based iron complex to be employed in this invention is accompanied with various problems that it is insufficient in electrification, poor in rise of electrification and prone to deteriorate in its life, the azo-based iron complex has been generally considered as being not suited for use as an agent for controlling the electrification of developing agent. However, it has been found by this invention that when this azo-based iron complex is used in combination with an electromagnetic induction heating, it is capable of effectively developing heat so as to make it possible to easily melt the binder resin, and that when this azo-based iron complex is used in combination with a binder resin having an acid value of 1 to 30, a glass transition temperature of 40 to 65° C. and a softening point of 80 to 140° C., it is possible to obtain a practical developing agent which is capable of overcoming the aforementioned problems and of remarkably improving various properties needed in a developing agent such as fluidity, electrification, cleaning property and fixing property.

More preferably, the binder resin to be employed in this invention should be selected from those having an acid value of 5 to 15, a glass transition temperature of 45 to 60° C. and a softening point of 90 to 130° C.

Preferably examples of this binder resin include polyester resin and styrene acrylic resin.

As for the polyester resin, it is possible to employ, as an alcohol monomer constituting the resin, diols such as ethylene glycol, diethylene glycol, triethylene glycol, 1,2-propylene glycol, 1,3-propylene glycol, 1,4-butane diol, neopentyl glycol, 1,4-butane diol, 1,5-pentane diol, 1,6-hexane diol, etc.; bisphenol A alkylene oxide adducts such as bisphenol A, hydrogenated bisphenol A, polyoxyethylenated bisphenol A, polyoxypropylenated bisphenol A, etc.; and other kinds of dihydric alcohol.

Among these monomers, those containing a bisphenol A alkylene oxide adduct as a main monomer are particularly preferably in obtaining a good result.

Namely, when a bisphenol A alkylene oxide adduct is employed as a constituent monomer, it is possible to obtain a polyester having a relatively high glass transition point because of the skeleton of bisphenol A, thus enabling to obtain an excellent anti-blocking property. Further, since the existence of an alkyl group on both sides of the skeleton of bisphenol A acts a soft segment in the polymer, it is possible to realize an excellent low temperature fixing property.

As for the acid monomer constituting the polyester, it is possible to employ alkenyl succinic acids or alkyl succinic acid such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, n-dodecenyl succinic acid, n-dodecyl succinic acid, etc.; acid anhydrides or alkyl ester of these acids; and other kinds of bivalent carboxylic acid.

As for the styrene acrylic resin, it is possible to employ a copolymer of styrene or substitutent thereof, and acrylic resins.

As for the copolymer of styrene or substitutent thereof, it is possible to employ polystyrene homopolymer, hydrogenated styrene resin, styrene-isobutylene copolymer, styrene-butadiene copolymer, acrylonitrile-butadiene-styrene terpolymer, acrylonitrile-acrylate-styrene terpolymer, acrylonitrile-styrene copolymer, acrylonitrile-acryl rubber-styrene terpolymer, acrylonitrile-chlorinated polystyrene-styrene terpolymer, acrylonitrile-EVA-styrene terpolymer, styrene-p-chlorostyrene copolymer, styrene-propylene copolymer, styrene-maleate copolymer, styrene-isobutylene copolymer, styrene-maleic anhydride copolymer, styrene-butadiene rubber, etc.

As for the acrylic resins, it is possible to employ polyacrylate, polymethyl methacrylate, polyethyl methacrylate, poly-n-butyl methacrylate, polyglycidyl methacrylate, fluorinated polyacrylate, styrene-methacrylate copolymer, styrene-butyl methacrylate copolymer, styrene-ethyl acrylate copolymer, etc.

The binder resin according to this invention may also comprises polyvinyl chloride, polyvinyl acetate, polyethylene, polypropylene, polyurethane, polyamide, epoxy resin, rosin, aromatic petroleum resin, chlorinated paraffin, paraffin wax, etc., which can be used singly or in combination thereof.

The binder resin according to this invention may also comprises 0.5 to 5 parts by weight of wax such as low molecular weight polypropylene, low molecular weight polyethylene, liquid paraffin, acid amide, stearate wax, montan wax, Sasol wax, castor wax, chlorinated paraffin, and Carnaba wax.

The content of the azo-based iron complex to be employed according to this invention in the toner particle should preferably be in the range of 0.5 to 5% by weight, more preferably in the range of 0.8 to 3.5% by weight.

As for the azo-based iron complex, it is possible to preferably employ compounds represented by the following structural formulas (1) to (6).

structural formula (1)
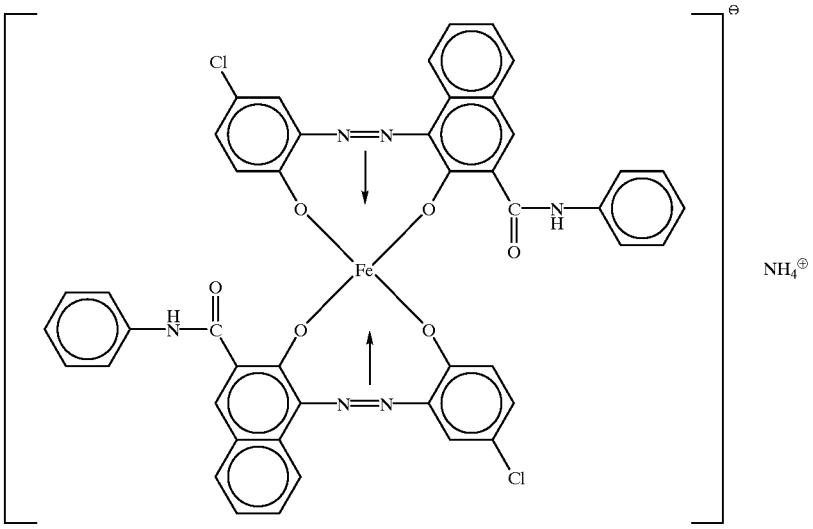
structural formula (2)
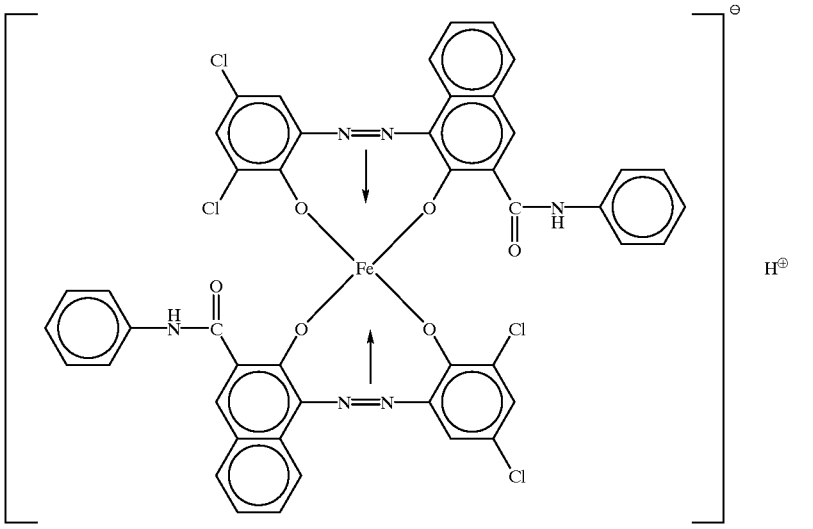
structural formula (3)
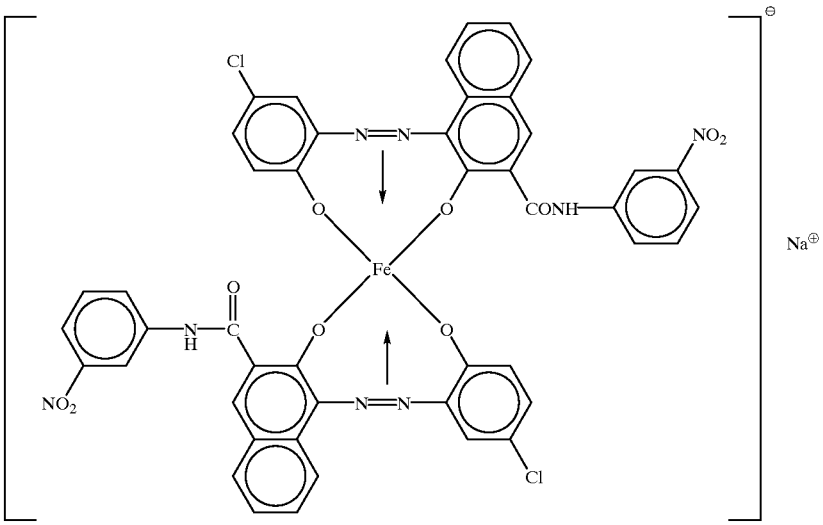

structural formula (4)
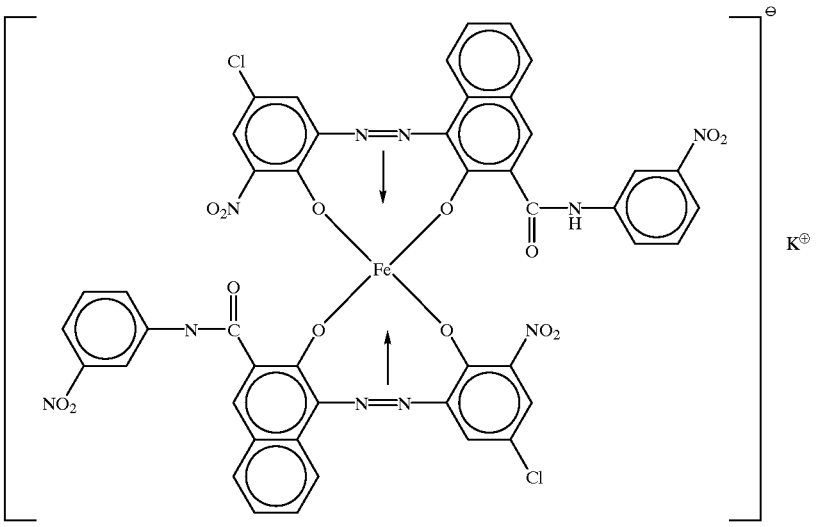
structural formula (5)
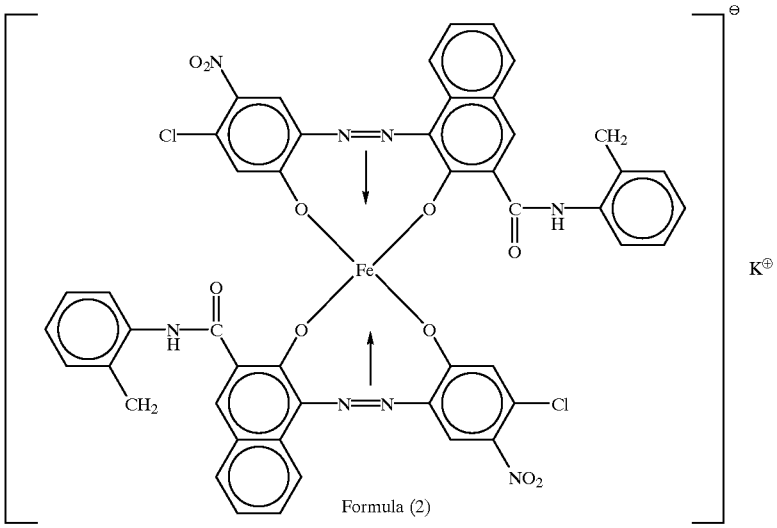
Formula (2)
structural formula (6)
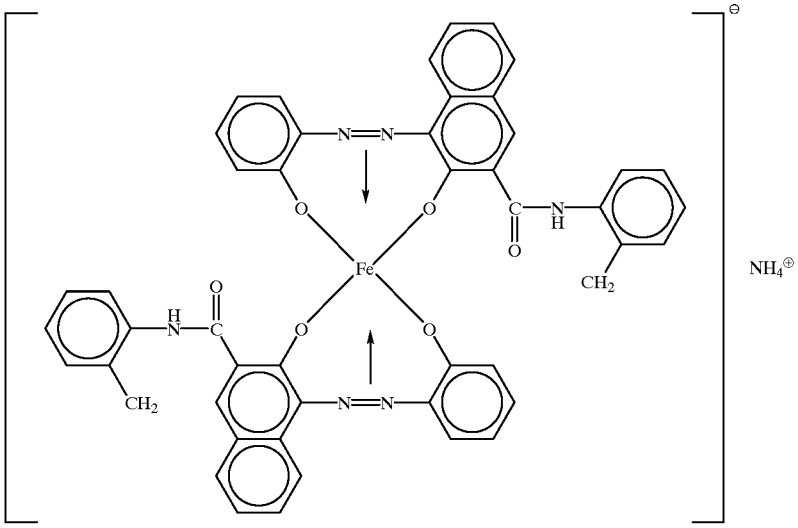

Further, it is possible to include a magnetic particle in the developing agent of this invention.

The addition of the magnetic particle to the toner can be performed by a method wherein the magnetic particle is allowed to be enclosed inside the toner particle, by a method wherein the magnetic particle is allowed to adhere onto the surface of the toner particle by mixing the magnetic particle together with the toner particle, or by adopting both of these methods.

If the magnetic particle is to be enclosed inside the toner particle, the content of the magnetic particle in the toner particle should preferably be confined to the range of 0.1 to 10% by weight.

If the magnetic particle is to be adhered onto the surface of the toner particle by mixing the magnetic particle together with the toner particle, the content of the magnetic particle should preferably be confined to the range of 0.5 to 2% by weight based on the entire weight of the toner particle.

If the addition of magnetic particle is to be performed by making use of both of these methods, the magnetic particle to be employed in both methods may be the same or different from each other. Further, if the addition of magnetic particle is to be performed by making use of both of these methods, the total content of the magnetic particle should preferably be confined to the range of 0.5 to 8% by weight based on the entire weight of the toner particle.

As for preferable examples of the magnetic particle, it includes an iron-containing metal oxide having an average particle diameter of 0.01 to 0.5 $\mu$m. Examples of such an iron-containing metal oxide are iron oxides such as ferrite and magnetite.

The developing agent according to this invention may preferably contain a coloring agent. However, if a magnetic particle capable of functioning as a coloring agent is to be added to the developing agent in a sufficient quantity to obtain a desired color, the addition of the coloring agent may be omitted.

Followings are preferable examples of coloring agent which can be employed in this invention.

As for the pigments to be employed as a yellow colorant, the examples thereof include a nitro-based pigment such as naphthol yellow S; an azo-based pigment such as Hansa Yellow 5G, Hansa Yellow 3G, Hansa Yellow G, Benzidine Yellow GR, Benzidine Yellow G and Vulcan Fast Yellow 5G; yellow iron oxide; and inorganic pigments such as loess.

As for the dyes to be employed as a yellow colorant, the examples thereof include oil soluble dyes such as C.I. Solvent yellow 2, C.I. Solvent Yellow 6, C.I. Solvent Yellow 14, C.I. Solvent Yellow 15, C.I. Solvent Yellow 16, C.I. Solvent Yellow 19 and C.I. Solvent Yellow 21, all of which are set forth in the color index.

As for the pigments to be employed as a Magenta colorant, the examples thereof include a quinacridone-based pigment such as C.I. Pigment 122 and C.I. Pigment Violet 19; a rhodamine-based pigment such as Rhodamine 6G lake, Rhodamine B lake and C.I. Pigment Red 81; a thioindigo pigment such as C.I. Pigment Red 87, C.I. Violet 1 and C.I. Pigment Violet 38; and an azo pigment such as Brilliant Carmine 6B and Lithol Rubin GK.

As for the dyes to be employed as a Magenta colorant, the examples thereof include oil soluble dyes such as C.I. Solvent Red 49, C.I. Solvent Red 19 and C.I. Solvent Red 52.

As for the pigments to be employed as a cyan colorant, the examples thereof include a phthalocyan-based pigment such as Phthalocyan Blue, Heliogen Blue G, Fast Sky Blue, C.I. Pigment Blue 15, C.I. Pigment Blue 16; C.I. Pigment Blue 17; C.I. Pigment Green 7, C.I. Pigment Green 7, C.I. Pigment Green 12, C.I. Pigment Green 36, C.I. Pigment Green 37 and C.I. Pigment Green 38.

As for the dyes to be employed as a cyan colorant, the examples thereof include oil soluble dyes such as C.I. Solvent Blue 25, C.I. Solvent Blue 55, C.I. Solvent Blue 70, C.I. Solvent Blue 40, C.I. Direct Blue 25 and C.I Direct Blue 86.

As for a black colorant, the examples thereof include various kinds of carbon black that can be manufactured by way of a Thermal Black method, an Acetylene Black method, a Channel Black method, A Furnace Black method, a Lamp Black method, etc.

These colorants may be used by modifying the aforementioned dyes or pigments, or used as a blend of two or more kinds thereof.

The developing agent of this invention can be used as a non-magnetic one-component developing agent. Alternatively, the developing agent of this invention can be used as a binary developing agent by mixing a toner particle with a carrier such as ferrite.

As for the additives to be mixed with a toner particle so as to adhere them onto the surface of toner particle, it is possible to employ a fine silica particle, a fine metal oxide particle, a cleaning assistant, etc. These additives can be added respectively as required at a ratio of 0.2 to 2 parts by weight based on the entire weight of the toner particle.

As for the fine silica particle, it is possible to employ silicon dioxide, aluminum silicate, sodium silicate, zinc silicate, magnesium silicate, etc. As for the fine metal oxide particle, it is possible to employ zinc oxide, titanium oxide, aluminum oxide, zirconium oxide, strontium titanate, barium titanate, etc.

As for the cleaning assistant, it is possible to employ a fine resin particle made for example of polymethyl methacrylate, polyvinylidene fluoride, polytetrafluoroethylene, etc.

These additives may be surface-treated to make them hydrophobic.

As for the mixing and dispersing means in the manufacture of the toner particle to be employed in the developing agent of this invention, it is possible to employ a wet dispersion method using a high-speed dissolver, a roll mill or a ball mill, or to employ a melt-kneading method using rolls, a press kneader, an internal mixer, a screw type extruder, etc.

As for the mixing means, it is possible to employ a ball mill, A V-type mixer, a vorbark, Henschel mixer, etc.

As for the means to coarsely crushing a mixture, it is possible to employ a hammer mill, a cutter mill, a roller mill, a ball mill, etc.

As for the means to finely pulverizing a coarsely crushed mixture, it is possible to employ a jet mill, a high-speed rotary crusher, etc.

As for the means to classifying a finely pulverized mixture, it is possible to employ an air classifier.

According to a second aspect of the present invention, there is provided an image-forming apparatus comprising;

an image carrier;

a developing device for forming developing agent image by developing an electrostatic latent image formed on said image carrier with said developing agent, said developing device being disposed opposite to face said image carrier and containing a developing agent;

a transferring device for transferring said developing agent image onto a recording material; and a fixing device for fixing said developing agent image transferred onto said recording material;

wherein the developing agent to be employed herein comprises a toner particle containing a binder resin having an acid value of 1 to 30, a glass transition temperature of 40 to 65° C. and a softening point of 80 to 140° C., an azo-based iron complex, and a coloring agent and/or a first magnetic particle; and the fixing device is provided with heating means of electromagnetic induction heating system.

Further, according to a third aspect of the present invention, there is provided an image-forming method which makes use of the image-forming apparatus of the aforementioned second aspect and comprises the steps of;

forming an electrostatic latent image on an image carrier;

developing said electrostatic latent image with a developing agent;

transferring a developing agent image thus developed onto a recording material; and fixing said developing agent image onto said recording material by press-heating said developing agent image;

wherein the developing agent to be employed herein comprises a toner particle containing a binder resin having an acid value of 1 to 30, a glass transition temperature of 40 to 65° C. and a softening point of 80 to 140° C., an azo-based iron complex, and a colorant and/or a first magnetic particle; and the heating in the fixing step is performed by an electromagnetic induction heating system.

As for the developing system to be preferably employed in this invention, a non-magnetic one-component developing system or a binary developing system can be employed.

The aforementioned fixing device of electro-magnetic induction heating system is provided with a high-frequency magnetic field generating means comprising an exciting coil which is wound around a core and a power source connected with the exciting coil. According to this fixing device, Joule heat to be generated at the moment of generating a magnetic field by the high-frequency magnetic field generating means can be employed as a heating source in the fixing step.

For example, in the case of fixing device provided with a heating member and a pressing member, the exciting coil can be built into the pressing member and/or the heating member having a magnetic metal surface.

Next, the apparatus of this invention will be specifically explained with reference to the accompanying drawings.

FIG. 1 shows a schematic view illustrating the construction of an image-forming apparatus representing one example of the present invention.

Referring to FIG. 1, a developing device 14 is disposed to face a latent image-holding body (a photoreceptor drum) 10 which is disposed rotatably. This photoreceptor drum 10 is designed to be rotated in the direction indicated by the arrow "a" by means of a main motor (not shown). An electrostatic latent image corresponding to an image information to be recorded is designed to be formed on the surface of the photoreceptor drum 10 by means of a laser beam emitted from a laser exposure device disposed separately.

Around the photoreceptor drum 10, there are successively arranged, along the rotational direction as indicated by the arrow "a", an electrification device 12 for electrifying the photoreceptor drum 10 up to a predetermined electric potential, a developing device 14 for developing an electrostatic latent image so as to form a toner image by feeding a toner to the electrostatic latent image that has been formed on the photoreceptor drum 10 by means of a laser exposure device disposed separately, a transferring device 16 for transferring the toner image onto a recording paper, a cleaning device 18 for wiping away an untransferred portion of the toner left remained on the surface of the photoreceptor drum 10, and a de-electrification device 19 for de-electrifying the electric charge remaining on the surface of the photoreceptor drum 10. In the embodiment shown in FIG. 1, the de-electrification device 19 is disposed integral with the housing of the cleaning device 18. However, the de-electrification device 19 may be disposed separately from the housing of the cleaning device 18.

Further, a toner de-electrification device may be interposed between the cleaning device 18 and the transferring device 16 so as to facilitate the cleaning of the untransferred toner. Additionally, a de-electrification device may be interposed between the developing device 14 and the transferring device 16 so as to facilitate the transfer of the toner onto the recording paper.

The cleaning device 18 is provided also with a drum holding portion for supporting the photoreceptor drum 10 on the occasion of mounting the photoreceptor drum 10 on the image-forming apparatus 1. Namely, the cleaning device 18 is utilized also as a drum-holding member.

The electrification device 12 comprises a corona wire 12*a* and a grid screen 12*b*, which are connected with a high-voltage circuit and a grid bias voltage-generating device (both not shown), respectively, thereby enabling the surface of the photoreceptor drum 10 to be electrified up to a predetermined surface voltage.

The developing device 14 is filled with a developing agent D consisting of a mixture comprising, in a predetermined ratio, a toner T containing a resin having an acid value of 1 to 30, a glass transition temperature of 45 to 65° C. and a softening point of 80 to 140° C., an azo-based iron complex and 0.1 to 10% of a magnetic particle, and a magnetic carrier covered with an insulating resin. In this developing device 14, a magnetic brush is formed on the surface of a developing agent carrier (developing roller) 14*a* by making use of the developing agent D, the magnetic brush being subsequently contacted with the photoreceptor drum 10 disposed to face opposite to the developing roller 14*a* and having an electrostatic latent image formed. thereon, thereby developing and visualizing the electrostatic latent image.

The developing agent D and the developing roller 14*a* are placed in the housing 14*b*. On the both ends, in the longitudinal direction, of the developing roller 14*a*, there is respectively disposed a guide roller 14*c* for maintaining a constant distance between the surface of non-magnetic sleeve forming the external circumference of the developing roller 14*a* and the photoreceptor layer on the surface of the photoreceptor drum 10. Other than this guide roller, it is also possible to employ, as an alternative method of keeping this constant distance, a member having a predetermined thickness which can be attached to the end portions of the photoreceptor drum by means of adhesion or coating. By these means, the interval between the surface of non-magnetic sleeve and the photoreceptor layer of the photoreceptor drum 10 can be maintained constantly.

Inside the sleeve of the developing roller 14*a*, there are arranged, along the circumferencial direction of the sleeve, a magnet medium comprising a plural number of S-pole and N-pole fixed magnets which are respectively orientated at a predetermined angle.

The magnetic particle C and the toner T, i.e. the developing agent D existing on the developing roller 14*a* and in the developing device 14 are designed to be impressed by a predetermined developing bias voltage through a developing bias voltage-generating circuit (not shown). As a result, the toner is caused, by the effect of image force, to adhere onto the heads of carrier which have been formed on the surface of the sleeve and along the magnetic line generated by the main pole of the magnetic medium of the developing roller 14*a*. On the occasion of developing an electrostatic latent image formed on the surface of the photosensitive drum 10, the toner thus adhered onto the carrier is caused to transfer in the developing region formed between the facing surfaces of the photosensitive drum 10 and the developing roller 14*a* due to an electric field formed by the effect of both of the electric potential of the electrostatic latent image of the photosensivite drum 10 and the developing bias voltage, thereby performing the developing of the electrostatic latent image. This developing system is a typical example of the binary developing system. However, it is also possible to apply the present invetnion to a non-magnetic one-component type developing device where neither the magnetic particle C nor fixed magnet to be built in the developing sleeve is employed.

The toner that has been transferred onto the a recording medium such as paper by means of the transferring devices 16 and 17 is heated and melted on a transferring unit 20 such as a belt or roller, and then, transferred to fixing units 21 and 22 thereby fixing the toner on the recording medium.

Figure 2:
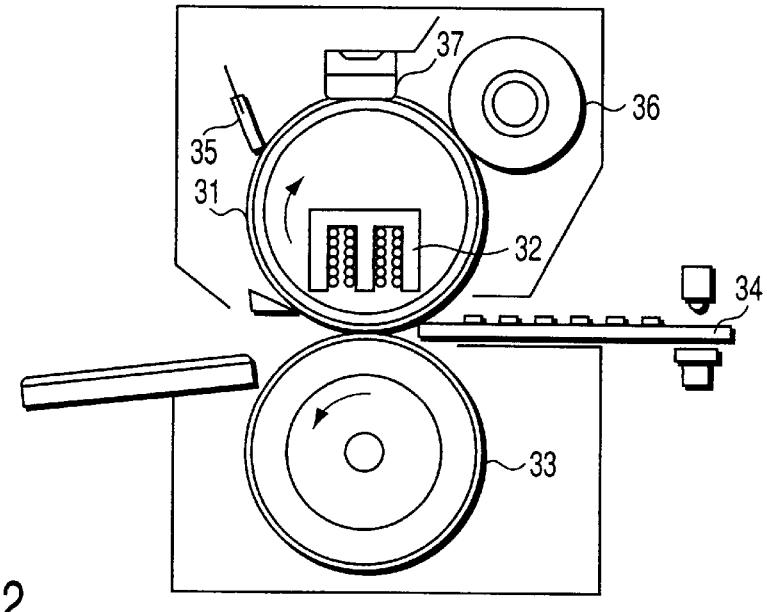
FIG. 2 is a schematic view illustrating the construction of one example of a fixing device to be employed in the present invention.

FIG. 2 schematically shows one example of the fixing unit. As shown in FIG. 2, this fixing unit is provided therein with a magnetic field-generating means 32, and further comprises a conductive roller 31 made of iron and having an outer diameter of 30 mm and a thickness of 0.6 mm, and a roller 33 disposed to face the conductive roller 31, both rollers being permitted to rotate in the direciton indicated by the arrows. Additionally, an oil coater 36, a cleaning blade 35 and an excessive oil-removing roller 37 are disposed in the mentioned order along the surfce of the conductive roller 31.

Figure 3:
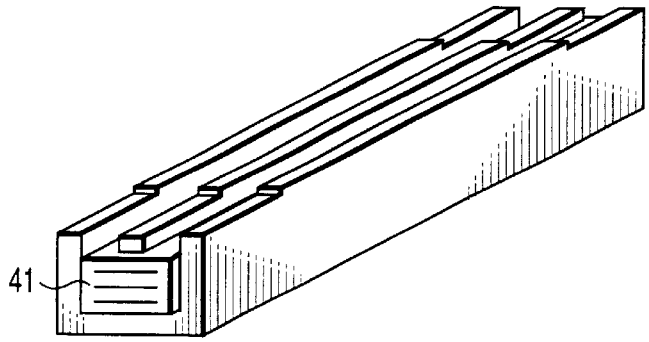
FIG. 3 is a perspective view illustrating the construction of one example of a high-frequency magnetism-generating apparatus to be employed in the present invention.

FIG. 3 schematically shows one example of the magnetic field-generating means 32. As shown in FIG. 3, this magnetic field-generating means 32 comprises a ferrite core for effectively controlling a magnetic flux, and a coil 41 would around the core and employing a litz wire consisting of 12 turns of four copper wires each having a diameter of 0.5 mm.

In this fixing unit, the conductive roller 31 is designed to be rotated in the direction indicated by the arrow by means of a drive transmission means (not shown) which is attached to an axial end portion of the conductive roller 31. The roller 33 is allowed to driven in the direction indicated by the arrow as it is pressed at a nip width of about 8 mm by the conductive roller 31. The magnetic field-generating means 32 is capable of generating an AC magnetic field by means of a high-frequency circuit (not shown), thereby causing an eddy current to generate on the conductive roller 31, the resultant Joule heat being utilized for concentratedly developing heat at the nip portion of the conductive roller 31. Further, the cleaning blade 35 is press-contacted with the rotating conductive roller 31 so as to remove any foreign matters existing onto the surface of the rotating conductive roller 31. On the other hand, the oil coater 36 is designed to coat silicone oil on the surface of the conductive roller 31, any excessive quantity of oil bing recovered by the excessive oil-removing roller 37, thereby making it possible to keep the uniformity of silicon oil on the surface of the conductive roller 31. By the way, one of these oil coater 36 and excessive oil-removing roller 37 may be provided with both of these functions, thereby making it possible to omit one of them.

According to this apparatus, a recording material 34 having a toner image transferred thereon is permitted to pass through an interface between a pair of rollers 31 and 33, thereby fixing the toner image onto the recording material 34.

According to this system wherein a heated portion is concentrated at the nip portion of the conductive roller 31, care is taken so as to enable the magnetic flux generated by the coil to be effectively acted on the conductive roller 31 in order to sufficiently utilize the effect of the magnetic flux and to enhance the fixing efficiency. It is very important to suitably control the gap between the core and the surface of the conductive roller 32 and to suitably set the mounting angle of the core for the purpose of avoiding any possiblity that the magnetic flux generated from the peripheral portion of one end of the core is consumed at the peripheral portion of the opposite end without being acted on the conductive roller 31. Since a magnetic field-generating means where a coil is wound around a ferrite core would become larger in weight as well as in sectional area as compared with a halogen lamp heater, the magnetic field-generating means should preferably be sustained by the both end portions of the core member.

If the material of the heat roller provided therein with a device comprising a core and a coil wound around the cores as mentioned above is constituted by a single material such as iron, cobalt and nickel; a composite material thereof; a mixture thereof with carbon, aluminum, tellurium or manganese; or an oxide thereof, the effect of the electromagnetic induction heating can be enhanced.

This invention will be further explained in detail with reference to the following examples. By the way, part(s) shown in the following description is based on weight unless otherwise specified.

EXAMPLE 1

A toner material having the following composition was prepared.

Stryreme acrylic resin (acid value: 10; glass transition point: 60° C.; and softening temperature: 130° C.) 83 parts

| | |
|---|---|
| Azo-based iron complex represented by the aforementioned structural formula (1) | 5 parts |
| Carbon black | 5 parts |
| Wax | 5 parts |
| Magnetic particle (iron trioxide) | 5 parts |

This toner material was melted and kneaded by making use of an extruder, thus obtaining a kneaded material.

This kneaded material was then coarsely crushed by means of a pin mill. This coarsely crushed matter was further finely pulverized by means of impact method, and then, classified by means of an air blow classifier to obtain a black toner particle having an average particle diameter of 8 $\mu$m.

Then, 0.5 part of a negatively electrified colloidal silica was added to this toner particle, thereby obtaining a black toner particle.

Then, by making use of a mixer, 5 parts of this black toner was mixed with 95 parts of ferrite carrier covered with a resin containing silicone resin as a main component, thereby obtaining a developing agent.

The developing agent thus obtained was charged into a developing device as shown in FIG. 1 so as to perform the copying of an image.

In this case, the photoreceptor drum 10 was allowed to rotate in the direction indicated by the arrow "a" and at the circumferential speed of 130 mm/sec. An electric charge of −600 v at the dark portion and −50 v at the bright portion was formed as an electrostatic latent image on the surface of the photoreceptor drum 10. Further, the distance between the sleeve and the surface of the photoreceptor drum 10 was set to 0.45 mm.

As a result, it was possible to obtain an excellent image which was free from the scattering of image. Further, the fixing property of the image was also very excellent.

EXAMPLES 2 to 4, and 7

A black toner was respectively obtained by repeating the same procedures as explained in Example 1 except that styrene acrylic resins each having a glass transition point and a softening point as indicated in the following Table 1 were employed together with the azo-based iron complex and the magnetic particle at the ratios as specified in the following Table 1. Then, copies of an image were prepared in the same manner as in Example 1 by making use of the black toners thus obtained. When the property of copied image as well as the fixing property thereof were evaluated, all of the images obtained were found excellent. The results are shown in the following Table 1.

EXAMPLES 5, 6, and 8

A black toner was respectively obtained by repeating the same procedures as explained in Example 1 except that styrene acrylic resins each having a glass transition point and a softening point as indicated in the following Table 1 were employed together with the azo-based iron complex and the magnetic particle at the ratios as specified in the following Table 1, and that the magnetic particle was added to the other components not at moment of the melt-kneading step, but after the formation of toner particle. Then, copies of an image were prepared in the same manner as in Example 1 by making use of the black toners thus obtained. When the property of copied image as well as the fixing property thereof were evaluated, all of the images obtained were found excellent. The results are shown in the following Table 1.

TABLE 1

| | Property of resin | | | Azo-Fe complex | | Magnetic | | |
|---|---|---|---|---|---|---|---|---|
| | Acid value | Glass transition point (° C.) | Softening point (° C.) | Formula | Content Wt % | particle Content Wt % | Fixing property | Image property |
| Example | | | | | | | | |
| 1 | 10 | 62 | 130 | 1 | 2 | 10 | ○ | ○ |
| 2 | 30 | 65 | 140 | 2 | 2 | 5 | ○ | ○ |
| 3 | 5 | 45 | 80 | 1 | 2 | 5 | ○ | ○ |
| 4 | 15 | 55 | 100 | 1 | 5 | 1 | ○ | ○ |
| 5 | 15 | 65 | 140 | 1 | 3 | 0.1 | ○ | ○ |
| 6 | 10 | 60 | 120 | 1 | 1 | 1 | ○ | ○ |
| 7 | 10 | 60 | 120 | 1 | 0.2 | 0 | Δ | Δ |
| Comparative Example 1 | 10 | 62 | 130 | — | — | 10 | ○ | X |
| Example 8 | 10 | 60 | 120 | 1 | 7 | 2 | ○ | Δ |
| Comparative Example 2 | 10 | 70 | 150 | 1 | 2 | ○ | X | ○ |

EXAMPLE 9

A toner material having the following composition was prepared.

Styrene acrylic resin (acid value: 15; glass transition point: 60° C.; and softening temperature: 130° C.) 88 parts

| | |
|---|---|
| Azo-based iron complex represented by the aforementioned structural formula (1) | 2 parts |
| Carbon black | 5 parts |
| Wax | 5 parts |

A black toner was obtained by making use of the aforementioned toner materials and by repeating the same procedures as explained in Example 1. Then, copies of an image were prepared in the same manner as in Example 1 by making use of the black toners thus obtained. When the property of copied image as well as the fixing property thereof were evaluated, all of the images obtained were found excellent. The results are shown in the following Table 2.

EXAMPLES 10 to 15

A black toner was respectively obtained by repeating the same procedures as explained in Example 9 except that styrene acrylic resins each having a glass transition point and a softening temperature as indicated in the following Table 2 were employed together with the azo-based iron complex and the magnetic particle at the ratios as specified in the following Table 2. Then, copies of an image were prepared in the same manner as in Example 8 by making use of the black toners thus obtained. When the property of copied image as well as the fixing property thereof were evaluated, all of the images obtained were found excellent. The results are shown in the following Table 2.

TABLE 2

| | Property of resin | | | Azo-Fe complex | | | |
|---|---|---|---|---|---|---|---|
| | Acid value | Glass transition point (° C.) | Softening point (° C.) | Material | Content Wt % | Fixing property | Image property |
| Example 9 | 10 | 62 | 130 | Sample 1 | 2 | ○ | ○ |
| Example 10 | 20 | 63 | 135 | Sample 2 | 2 | ○ | ○ |
| Example 11 | 5 | 45 | 80 | Sample 1 | 2 | ○ | ○ |

TABLE 2-continued

| | Property of resin | | | Azo-Fe complex | | | |
|---|---|---|---|---|---|---|---|
| | Acid value | Glass transition point (° C.) | Softening point (° C.) | Material | Content Wt % | Fixing property | Image property |
| Example 12 | 15 | 55 | 100 | Sample 1 | 5 | ○ | ○ |
| Example 13 | 15 | 65 | 140 | Sample 3 | 3 | ○ | ○ |
| Example 14 | 10 | 60 | 120 | Sample 4 | 1 | ○ | ○ |
| Comparative Example 3 | 3 | 62 | 130 | — | — | X | X |
| Example 15 | 10 | 60 | 120 | Sample 1 | 7 | ○ | Δ |

As seen from Table 1 and 2, it was found that by making use of developing agents of the present invention, it was possible to improve the property of image as well as the fixing property thereof as demonstrated in Examples 1 to 15. By contrast, when the azo-based iron complex was not employed as in the cases of Comparative Examples 1 and 3, or when the property of resin such as softening point was outside the specified range of the present invention as the case of Comparative Example 2, it was impossible to obtain an excellent image.

Further, as shown in Examples 1 to 6 and Examples 9 to 14, when the content of the azo-based iron complex was within the range of 0.5 to 5% by weight, the images to be obtained became more excellent.

What is claimed is:

1. An image-forming apparatus comprising:

an image carrier;

a developing device for forming a developing agnet image through a development of an electrostatic latent image formed on said image carrier, said developing device being disposed opposite to the image carrier and containing a developing agent comprising a toner particle containing a binder resin having an acid value of 1 to 30, a glass transition temperature of 40 to 65° C. and a softening point of 80 to 140° C., an azo-based iron complex, and at least one of a colorant and a first magnetic particle, said first magnetic particle being included in said toner particle at a ratio of 0.1 to 10% by weight;

a transferring device for transferring said developing agnet image onto a recording material; and a fixing device of electromagnetic induction heating system for fixing said developing agent image transferred onto said recording material.

2. The image-forming apparatus according to claim 1, wherein said fixing device comprises a heating member having a magnetic metal surface, a pressing member, an exciting coil placed inside said heating member and/or said pressing member, and means for generating a high-frequency magnetic field and connected with said exciting coil.

3. The image-forming apparatus according to claim 1, wherein said azo-based iron complex is included in said toner particle at a ratio of 0.5 to 5% by weight.

4. The image-forming apparatus according to claim 1, wherein said azo-based iron complex is selected from the group consisting of the compounds represented by the following structural formulas (1) to (6)

structural formula (1)

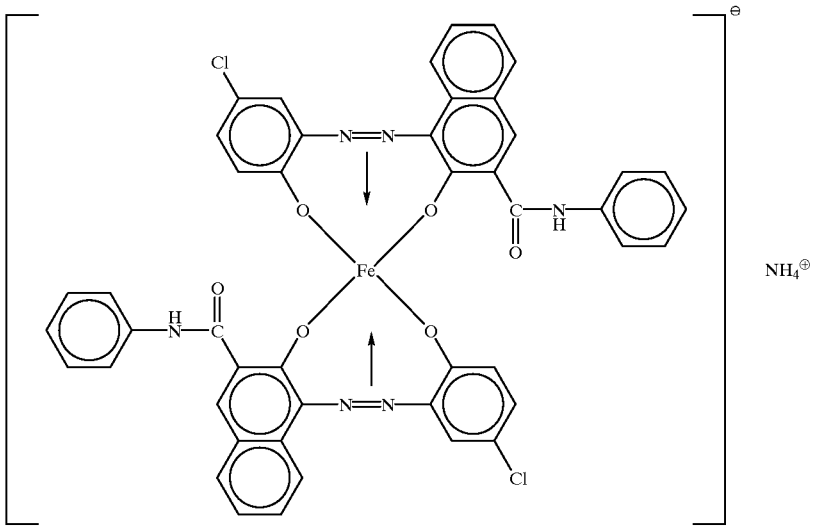

structural formula (2)
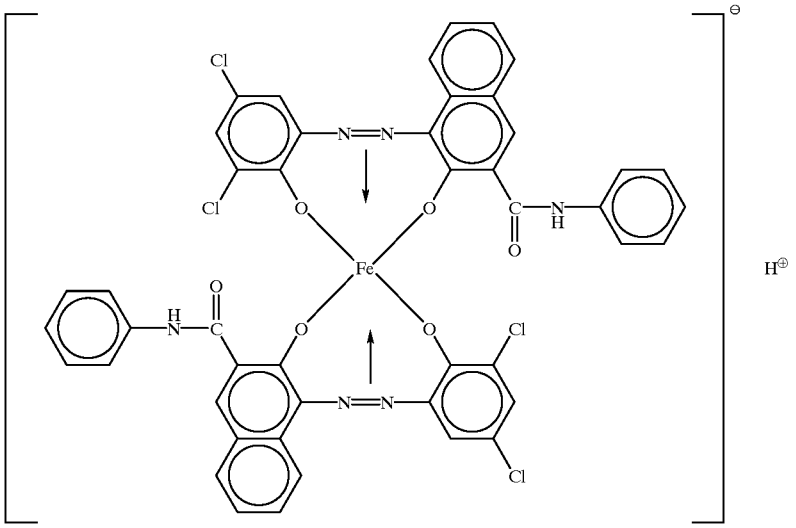
structural formula (3)
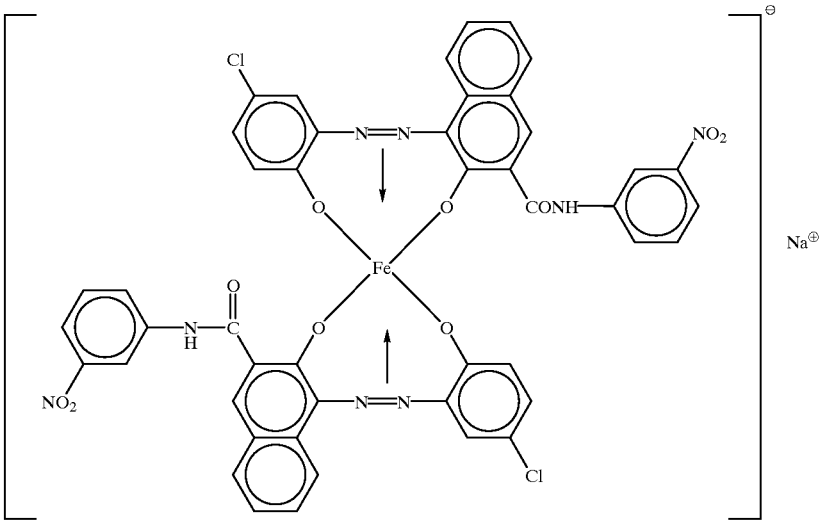
structural formula (4)
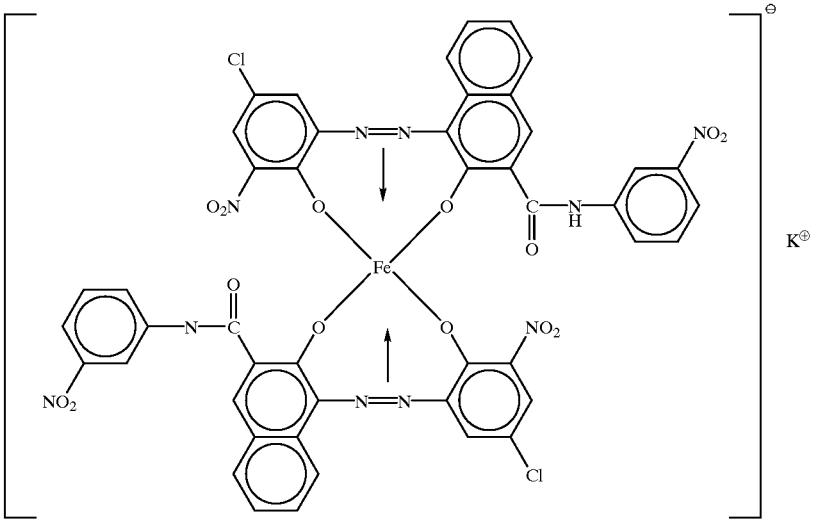

structural formula (5)

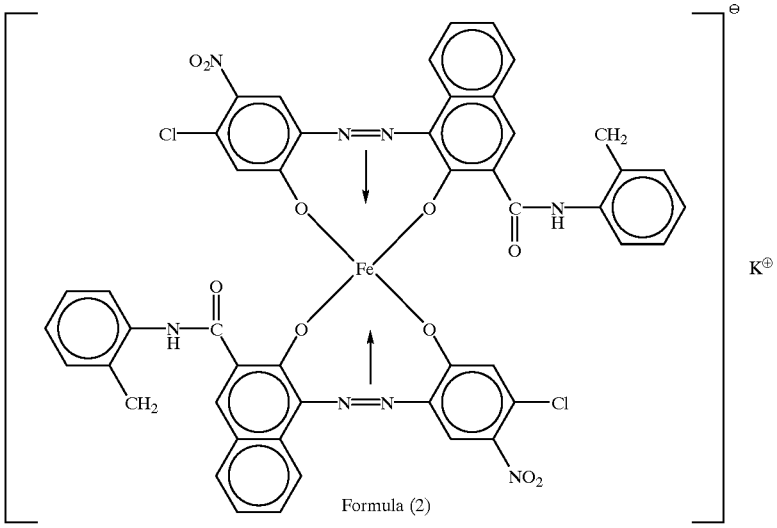

Formula (2)

structural formula (6)

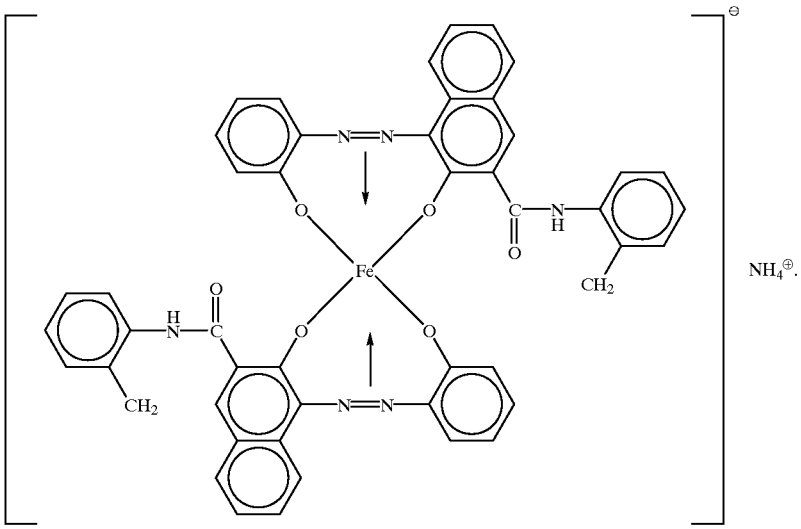

5. The image-forming apparatus according to claim 1, wherein said first magnetic particle is internally added in said toner particle.

6. The image-forming apparatus accoridng to claim 5, which further comprises a second magnetic particle to be mixed with said toner particle.

7. The image-forming apparatus according to claim 6, wherein said second magnetic particle is included in said toner particle at a ratio of 0.1 to 5% by weight.

8. The image-forming apparatus according to claim 6, wherein a total content of said first magnetic particle and said second magnetic particle is in the range of 0.5 to 8% by weight based on the entire weight of toner particle.

9. The image-forming apparatus according to claim 5, wherein said first magnetic particle is included in said toner particle at a ratio of 0.1 to 5% by weight.

10. The image-forming apparatus according to claim 1, wherein said first magnetic particle is externally added on said toner particle.

11. An image-forming method which comprise the steps of:

forming an electrostatic latent image on an image carrier;

developing said electrostatic latent image by making use of a developing agent comprising a toner particle containing a binder resin having an acid value of 1 to 30, a glass transition temperature of 40 to 65° C. and a softening point of 80 to 140° C., an azo-based iron complex, and a colorant and/or a first magnetic particle, said first magnetic particle being included in said toner particle at a ratio of 0.1 to 10% by weight;

transferring a developing agnet image thus developed onto a recording material; and fixing said developing agent image onto said recording material by heating said developing agent image according to an electromagnetic induction heating system while pressing said developing agent image transferred onto said recording material.

12. The image-forming method according to claim 11, wherein said fixing device comprises a heating member having a magnetic metal surface, a pressing member, an exciting coil placed inside said heating member and/or said pressing member, and means for generating a high-frequency magnetic field and connected with said exciting coil.

13. The image-forming method according to claim 11, wherein said azo-based iron complex is included in said toner particle at a ratio of 0.5 to 5% by weight.

14. The image-forming method according to claim 11, wherein said azo-based iron complex is selected from the group consisting of the compounds represented by the following structural formulas (1) and (6)

structural formula (1)

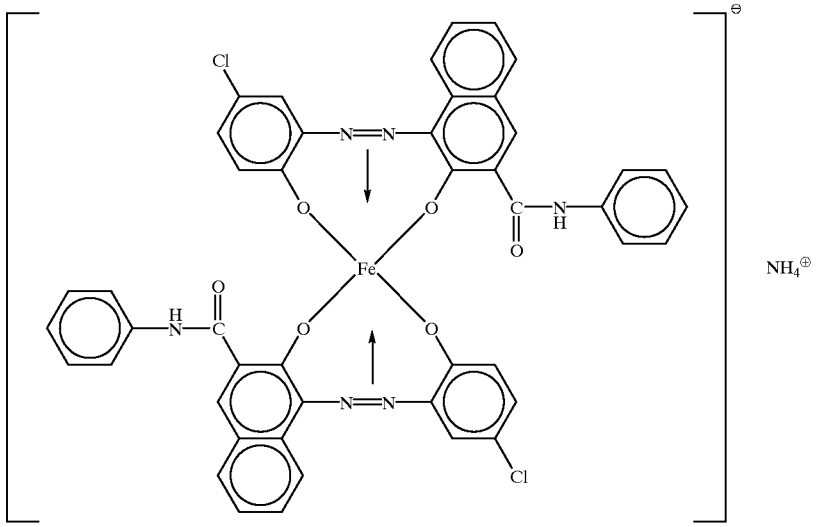

structural formula (2)

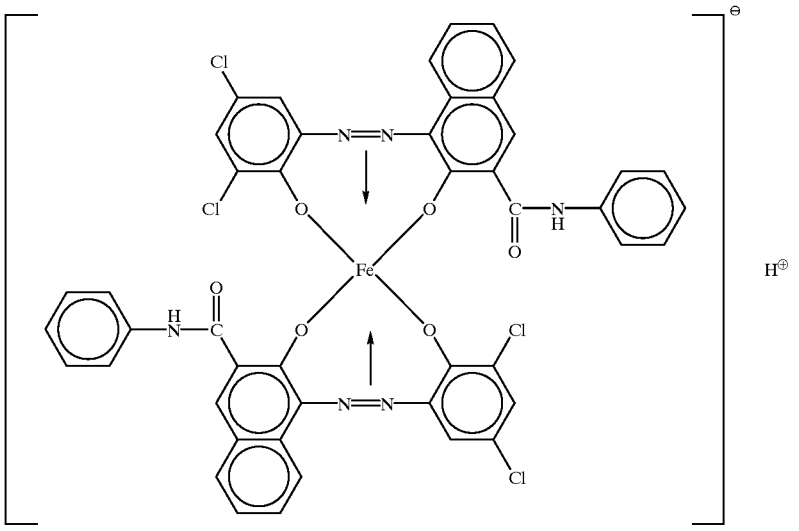

structural formula (3)
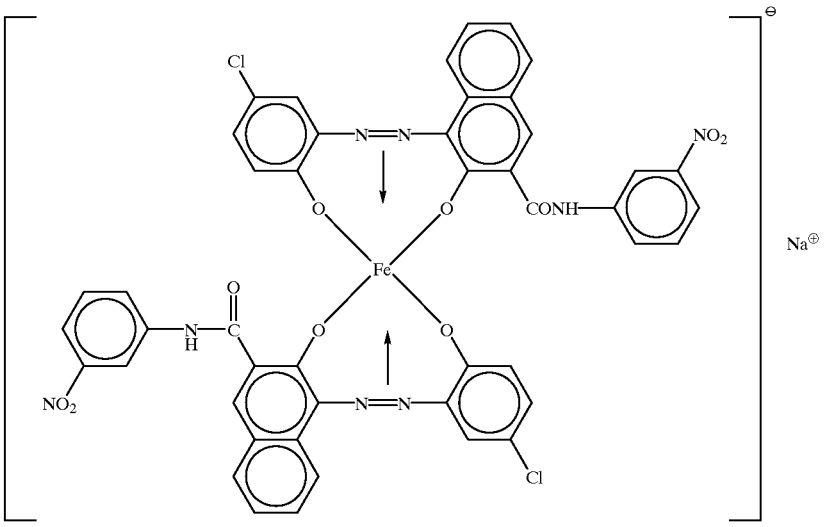
structural formula (4)
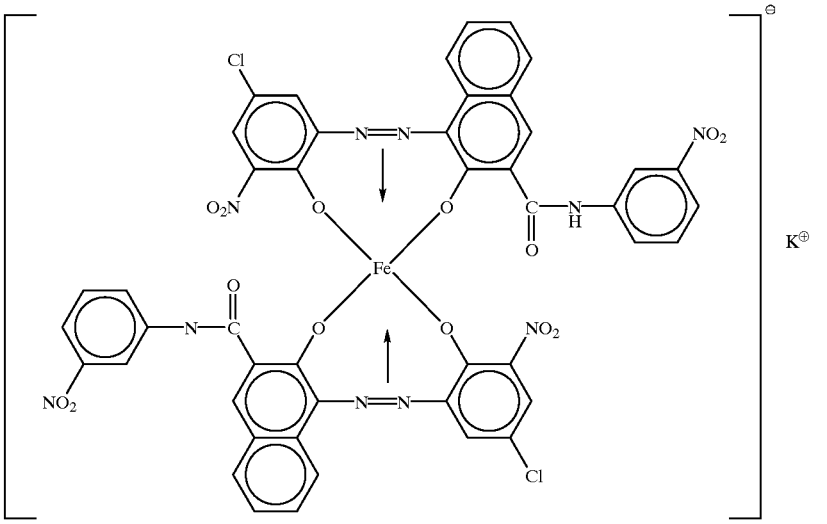
structural formula (5)
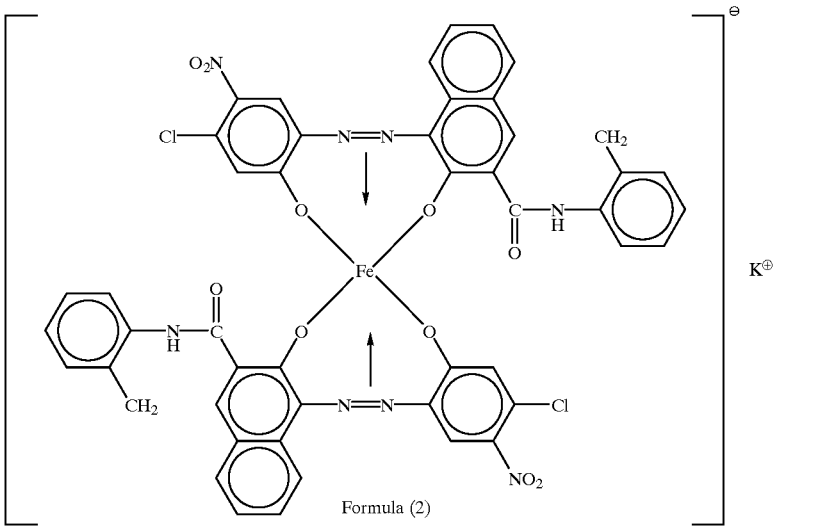
Formula (2)

structural formula (6)

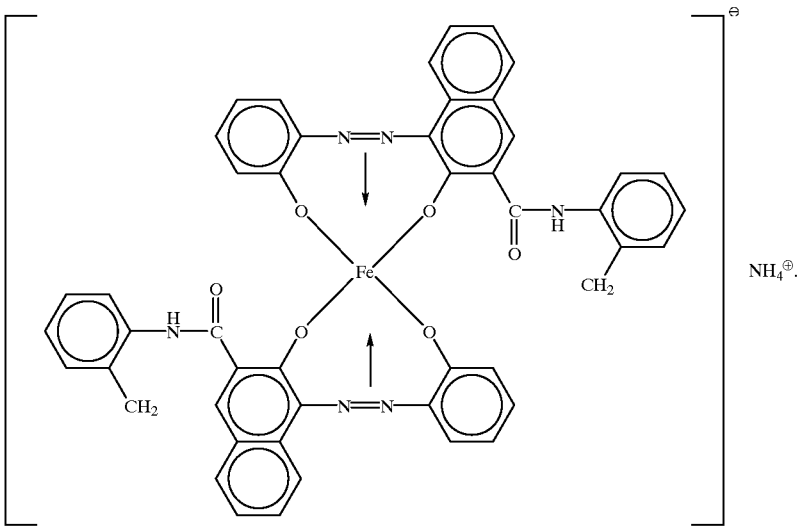

15. The image-forming method according to claim 11, wherein said first magnetic particle is internally added in said toner particle.

16. The image-forming method according to claim 15, which further comprises a second magnetic particle to be mixed with said toner particle.

17. The image-forming method according to claim 16, wherein said second magnectic particle is included in said toner particle at a ratio of 0.1 to 5% by weight.

18. The image-formiing method according to claim 16, wherein a total content of said first magnetic particle and said seocnd magnetic particle is in the range of 0.5 to 8% by weight based on the entire weight of toner particle.

19. The image-forming method according to claim 15, wherein said first magnetic particle is included in said toner particle at a ratio of 0.1 to 5% by weight.

20. The image-forming method according to claim 11, wherein said first magnetic particle is externally added on said toner particle.

* * * * *